US010487424B2

(12) United States Patent
Stanhope et al.

(10) Patent No.: US 10,487,424 B2
(45) Date of Patent: Nov. 26, 2019

(54) FLAME RESISTANT FABRICS HAVING FIBERS CONTAINING ENERGY ABSORBING AND/OR REFLECTING ADDITIVES

(71) Applicant: SOUTHERN MILLS, INC., Union City, GA (US)

(72) Inventors: Michael T. Stanhope, Atlanta, GA (US); Dominique Janay Adams, Fairburn, GA (US); Charles S. Dunn, Griffin, GA (US)

(73) Assignee: Southern Mills, Inc., Union City, GA (US)

( * ) Notice: Subject to any disclaimer, the term of this patent is extended or adjusted under 35 U.S.C. 154(b) by 0 days.

(21) Appl. No.: 15/630,395

(22) Filed: Jun. 22, 2017

(65) Prior Publication Data

US 2017/0370032 A1 Dec. 28, 2017

Related U.S. Application Data

(60) Provisional application No. 62/434,733, filed on Dec. 15, 2016, provisional application No. 62/353,693, filed on Jun. 23, 2016.

(51) Int. Cl.
*D03D 15/12* (2006.01)
*D01F 6/60* (2006.01)
(Continued)

(52) U.S. Cl.
CPC ..... *D03D 15/12* (2013.01); *D01F 1/04* (2013.01); *D01F 6/605* (2013.01); *D02G 3/047* (2013.01); *D02G 3/443* (2013.01); *D03D 1/0035* (2013.01); *D01F 1/06* (2013.01); *D10B 2331/021* (2013.01); *D10B 2501/04* (2013.01)

(58) Field of Classification Search
CPC .. D01F 1/04; D01F 1/06; D01F 6/605; D02G 3/047; D02G 3/443; D03D 15/12; D03D 1/0035; D10B 2331/021; D10B 2501/04
See application file for complete search history.

(56) References Cited

U.S. PATENT DOCUMENTS 4,996,099 A 2/1991 Cooke et al.
5,514,457 A 5/1996 Fels et al.
(Continued)

FOREIGN PATENT DOCUMENTS

WO 2000/000686 1/2000
WO 2004/002254 1/2004
(Continued)

OTHER PUBLICATIONS

DRIFIRE, 2015 Product Line, "Introducing Our Lightest Dual Hazard Fabric Ever", 2015, 3 pgs.
(Continued)

*Primary Examiner* — Arti Singh-Pandey
(74) *Attorney, Agent, or Firm* — Kilpatrick Townsend & Stockton LLP

(57) ABSTRACT

Embodiments of the invention relate to flame resistant fabrics containing fibers having at least one energy absorbing and/or reflecting additive incorporated into the fibers. Inclusion of such fibers into the fabric increases the arc rating/fabric weight ratio of the fabric while still complying with all requisite thermal protective requirements.

24 Claims, 1 Drawing Sheet

(51) Int. Cl.

| | |
|---|---|
| ***D02G 3/04*** | (2006.01) |
| ***D02G 3/44*** | (2006.01) |
| ***D03D 1/00*** | (2006.01) |
| ***D01F 1/04*** | (2006.01) |
| *D01F 1/06* | (2006.01) |

(56) References Cited

U.S. PATENT DOCUMENTS

| | | | | |
|---|---|---|---|---|
| 8,528,120 | B2 | 9/2013 | Underwood et al. | |
| 8,741,789 | B2 | 6/2014 | Cliver et al. | |
| 10,030,326 | B2 | 7/2018 | Hines, Jr. et al. | |
| 2010/0009186 | A1 | 1/2010 | Zhu et al. | |
| 2010/0299816 | A1 | 12/2010 | Zhu et al. | |
| 2010/0299817 | A1 | 12/2010 | Zhu et al. | |
| 2011/0010827 | A1 | 1/2011 | Stanhope et al. | |
| 2011/0250810 | A1 | 10/2011 | Zhu et al. | |
| 2011/0281097 | A1 | 11/2011 | Li et al. | |
| 2012/0102632 | A1 | 5/2012 | Zhu et al. | |
| 2012/0122361 | A1 | 5/2012 | Hand et al. | |
| 2012/0159697 | A1 | 6/2012 | Zhu et al. | |
| 2012/0286177 | A1 | 11/2012 | Cliver et al. | |
| 2013/0055490 | A1* | 3/2013 | Zhu | D03D 13/004 2/458 |
| 2013/0055491 | A1 | 3/2013 | Zhu et al. | |
| 2013/0216810 | A1 | 8/2013 | Hines et al. | |
| 2014/0026303 | A1 | 1/2014 | Zhu et al. | |
| 2014/0187113 | A1 | 7/2014 | Hines et al. | |
| 2015/0322598 | A1 | 11/2015 | Stanhope et al. | |
| 2015/0361599 | A1* | 12/2015 | Minor | D03D 15/0088 442/92 |
| 2016/0201236 | A1 | 7/2016 | Matsumoto et al. | |
| 2016/0362831 | A1* | 12/2016 | Minor | D06M 15/256 |
| 2017/0295875 | A1 | 10/2017 | Ohzeki et al. | |

FOREIGN PATENT DOCUMENTS

| | | | |
|---|---|---|---|
| WO | 2012/121759 | A2 | 9/2012 |
| WO | 2017/070529 | | 4/2017 |
| WO | 2017/150341 | A1 | 9/2017 |

OTHER PUBLICATIONS

GlenGuard™ FR, Glen Raven Technical Fabrics, LLC, 4 pgs, Admitted Prior Art.

PCT International Search Report and Written Opinion, PCT Application No. PCT/US17/38776, dated Sep. 25, 2017.

International Preliminary Report on Patentability, PCT Application No. PCT/US2017/038776, dated Jan. 3, 2019.

Mathur et al., "Color and Weave Relationship in Woven Fabrics", Advances in Modern Woven Fabrics Technology, IntechOpen, Jul. 27, 2011, 24 pages.

Yang et al., "A Durable Flame Retardant for Cellulosic Fabrics", Polymer degradation and stability, vol. 97, Issue 11, Nov. 1, 2012, pp. 2467-2472.

Office Action, U.S. Appl. No. 15/892,353, dated Jul. 25, 2019, 6 pages.

* cited by examiner

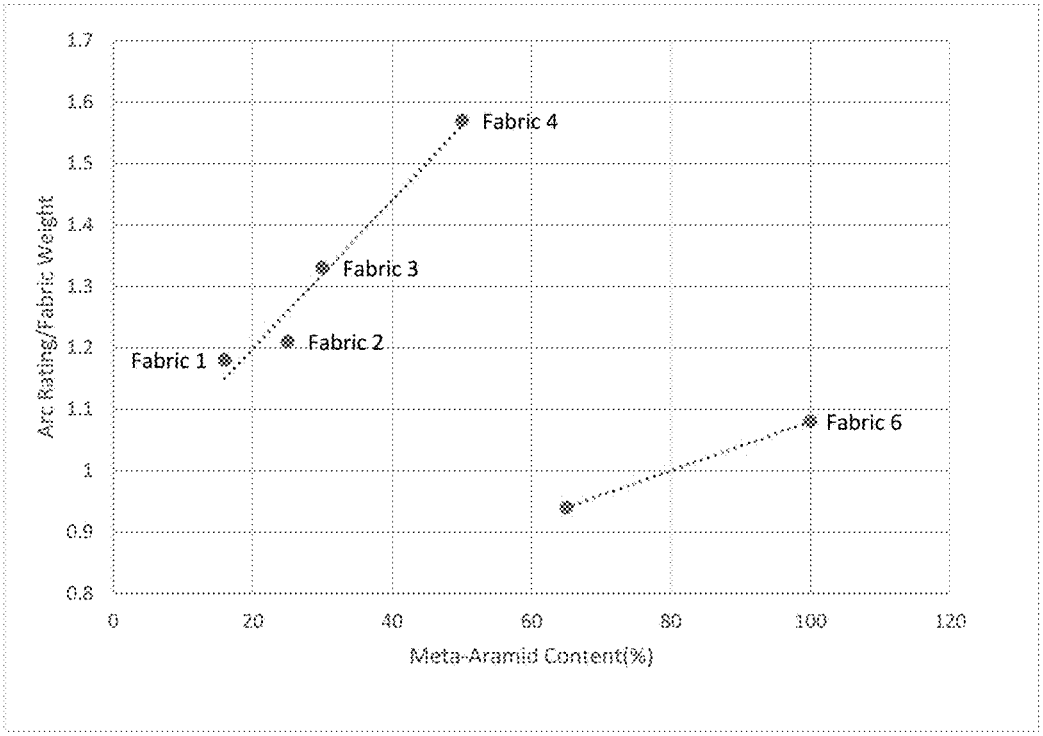
1.7
1.6
1.5
1.4
1.3
1.2
1.1
1
0.9
0.8
Arc Rating/Fabric Weight
0
20
40
60
80
100
120
Meta-Aramid Content(%)
Fabric 1
Fabric 2
Fabric 3
Fabric 4
Fabric 6

FLAME RESISTANT FABRICS HAVING FIBERS CONTAINING ENERGY ABSORBING AND/OR REFLECTING ADDITIVES

CROSS-REFERENCE TO RELATED APPLICATIONS

This application claims the benefit of U.S. Provisional Application No. 62/353,693, filed Jun. 23, 2016 and entitled "Flame Resistant Fabrics Containing Producer-Colored Aramid Fibers," and claims the benefit of U.S. Provisional Application No. 62/434,733, filed Dec. 15, 2016 and entitled "Flame Resistant Fabrics Containing Energy Absorbing and/or Reflective Additives," the entirety of both of which are hereby incorporated by reference.

FIELD

The present invention relates to flame resistant protective fabrics and garments made therefrom that impart improved protection to the wearer.

BACKGROUND

Many occupations can potentially expose an individual to electrical arc flash and/or flames. Workers who may be exposed to accidental electric arc flash and/or flames risk serious burn injury unless they are properly protected. To avoid being injured while working in such conditions, these individuals typically wear protective garments constructed of flame resistant materials designed to protect them from electrical arc flash and/or flames. Such protective clothing can include various garments, for example, coveralls, pants, and shirts. Standards have been promulgated that govern the performance of such garments (or constituent layers or parts of such garments) to ensure that the garments sufficiently protect the wearer in hazardous situations. Fabrics from which such garments are constructed, and consequently the resulting garments as well, are required to pass a variety of safety and/or performance standards, including ASTM F1506, NFPA 70E, and NFPA 2112.

ASTM F1506 (Standard Performance Specification for Flame Resistant and Arc Rated Textile Materials for Wearing Apparel for Use by Electrical Workers Exposed to Momentary Electric Arc and Related Thermal Hazards, 2015 edition, incorporated herein by reference) requires arc rating testing of protective fabrics worn by electrical workers. The arc rating value represents a fabric's performance when exposed to an electrical arc discharge. The arc rating is expressed in cal/cm$^2$ (calories per square centimeter) and is derived from the determined value of the arc thermal performance value (ATPV) or Energy Breakopen threshold ($E_{BT}$). ATPV is defined as the arc incident energy on a material that results in a 50% probability that sufficient heat transfer through the specimen is predicted to cause the onset of second-degree burn injury based on the Stoll Curve. $E_{BT}$ is the arc incident energy on a material that results in a 50% probability of breakopen. Breakopen is defined as any open area in the material at least 1.6 cm$^2$ (0.5 in.$^2$). The arc rating of a material is reported as either ATPV or $E_{BT}$, whichever is the lower value. The ATPV and $E_{BT}$ is determined pursuant to the testing methodology set forth in ASTM F1959 (Standard Test Method for Determining the Arc Rating of Materials for Clothing, 2014 edition, incorporated herein by reference), where sensors measure thermal energy properties of protective fabric specimens during exposure to a series of electric arcs.

NFPA 70E (Standard for Electrical Safety in the Workplace, 2015 edition, incorporated herein by reference) offers a method to match protective clothing to potential exposure levels incorporating Personal Protective Equipment (PPE) Categories. Protective fabrics are tested to determine their arc rating, and the measured arc rating determines the PPE Category for a fabric as follows:

PPE Category and ATPV
PPE Category 1: ATPV/EBT: 4 cal/cm$^2$
PPE Category 2: ATPV/EBT: 8 cal/cm$^2$
PPE Category 3: ATPV/EBT: 25 cal/cm$^2$
PPE Category 4: ATPV/EBT: 40 cal/cm$^2$ Thus, NFPA 70E dictates the level of protection a fabric must possess to be worn by workers in certain environments.

NFPA 2112 (Standard on Flame-Resistant Garments for Protection of Industrial Personnel Against Flash Fire, 2012 edition, incorporated herein by reference) governs the required performance of industrial worker garments that protect against flash fires. Both NFPA 2112 and ASTM F1506 require that the garments and/or individual layers or parts thereof pass a number of different performance tests, including compliance with the thermal protective requirements of having a char length of 4 inches or less (NFPA 2112) or 6 inches or less (ASTM F1506) and of having a two second (or less) afterflame (NFPA 2112 and ASTM F1506), when measured pursuant to the testing methodology set forth in ASTM D6413 (Standard Test Method for Flame Resistance of Textiles, 2015 edition, incorporated herein by reference).

To test for char length and afterflame, a fabric specimen is suspended vertically over a flame for twelve seconds. The fabric must self-extinguish within two seconds (i.e., it must have a 2 second or less afterflame). After the fabric self-extinguishes, a specified amount of weight is attached to the fabric and the fabric lifted so that the weight is suspended from the fabric. The fabric will typically tear along the charred portion of the fabric. The length of the tear (i.e., the char length) must be 4 inches or less (ASTM 2112) or 6 inches or less (ASTM F1506) when the test is performed in both the machine/warp and cross-machine/weft directions of the fabric. A fabric sample is typically tested for compliance both before it has been washed (and thus when the fabric still contains residual—and often flammable—chemicals from finishing processes) and after a certain number of launderings (e.g., 100 launderings for NFPA 2112 and 25 launderings for ASTM F1506).

NFPA 2112 also contains requirements relating to the extent to which the fabric shrinks when subjected to heat. To conduct thermal shrinkage testing, marks are made on the fabric a distance from each other in both the machine/warp and cross-machine/weft directions. The distance between sets of marks is noted. The fabric is then suspended in a 500 degree Fahrenheit oven for 5 minutes. The distance between sets of marks is then re-measured. The thermal shrinkage of the fabric is then calculated as the percentage that the fabric shrinks in both the machine/warp and cross-machine/weft directions and must be less than the percentage set forth in the applicable standard. For example, NFPA 2112 requires that fabrics used in the construction of flame resistant garments exhibit thermal shrinkage of no more than 10% in both the machine/warp and cross-machine/weft directions.

In the electrical safety market, there is a need for flame resistant fabrics that achieve a high arc rating/fabric weight ratio while still complying with all applicable thermal protective requirements. More specifically, there is a need for lighter weight protective fabrics that achieve NFPA 70E PPE Category 2 protection (≥8 cal/cm$^2$ arc rating). Due to high temperature working conditions in some workplaces, end users also have a need for comfortable (e.g., breathable) protective fabrics that have excellent moisture management properties (e.g., wicking).

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention relate to flame resistant fabrics containing fibers having at least one energy absorbing and/or reflecting additive incorporated into the fibers. Inclusion of such fibers into the fabric increases the arc rating/fabric weight ratio of the fabric while still complying with all requisite thermal protective requirements.

BRIEF DESCRIPTION OF THE FIGURES

FIG. 1 is a graph that plots the arc rating/fabric weight ratio for Fabrics 1-6 of Tables 1 and 2.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the flame resistant ("FR") fabrics disclosed herein are formed from a blend of different fibers, at least some of which include energy (e.g., radiation) absorbing and/or reflecting additives. It is believed that such additives serve to prevent heat energy transmission through the fabric and to the wearer's skin by absorbing the energy and/or reflecting the energy away from the fabric such that it does not reach the wearer. Examples of such additives include, but are not limited to, dye or pigment additives, such as (but not limited to):

- carbon black;
- anthraquinone black;
- aniline black;
- phthalocyanines;
- perylene diimides;
- terrylene diimides;
- quaterrylene diimides;
- vat dyes (e.g., vat black 8, vat black 16, vat black 20, vat black 25, vat blue 8, vat blue 19, vat blue 43, vat green 1);
- graphite;
- graphene;
- metal oxides (white titanium dioxide, $TiO_2$, silica, and yellow, brown, and black iron oxides); and
- a vat dye selected from the group consisting of dibenzanthrone derivatives, isobenzanthrone derivatives, and pyrazolanthrone derivatives.

Additive-containing fibers ("AC fibers") are fibers whereby an energy absorbing and/or reflecting additive, including but not limited to those identified above, is introduced during the process of manufacturing the fibers themselves and not after fiber formation. This is in contrast to a finish applied onto the fabric surface whereby a binder typically must be used to fix the additive onto the fabric. In these cases, the additive is apt to wash and/or wear/abrade off the fabric during laundering. Provision of the additive in the fibers during fiber formation results in better durability as the additive is trapped within the fiber structure.

In some embodiments, at least some (or all) of the AC fibers used in embodiments of the blend are producer-colored fibers. In producer coloring (also known as "solution dyeing"), pigment is injected into the polymer solution prior to forming the fibers. Thus, "producer-colored" fibers refers to fibers that are colored during the process of manufacturing the fibers themselves and not after fiber formation.

The blend may include inherently FR fibers and/or non-inherently FR fibers (FR or non-FR) that are incorporated such that the resulting fabric is flame resistant. Exemplary suitable FR and non-FR fibers include, but are not limited to, para-aramid fibers, meta-aramid fibers, polybenzoxazole ("PBO") fibers, polybenzimidazole ("PBI") fibers, modacrylic fibers, poly{2,6-diimidazo[4,5-b:40; 50-e]-pyridinylene-1,4(2,5-dihydroxy)phenylene} ("PIPD") fibers, ultra-high molecular weight (UHMW) polyethylene fibers, UHMW polypropylene fibers, polyvinyl alcohol fibers, polyacrylonitrile (PAN) fibers, liquid crystal polymer fibers, glass fibers, nylon (and FR nylon) fibers, carbon fibers, silk fibers, polyamide fibers, polyester fibers, aromatic polyester fibers, natural and synthetic cellulosic fibers (e.g., cotton, rayon, acetate, triacetate, and lyocell, as well as their flame resistant counterparts FR cotton, FR rayon, FR acetate, FR triacetate, and FR lyocell), TANLON™ fibers (available from Shanghai Tanlon Fiber Company), wool fibers, melamine fibers (such as BASOFIL™, available from Basofil Fibers), polyetherimide fibers, polyethersulfone fibers, pre-oxidized acrylic fibers, polyamide-imide fibers such as KERMEL™, polytetrafluoroethylene fibers, polyvinyl chloride fibers, polyetheretherketone fibers, polyetherimide fibers, polychlal fibers, polyimide fibers, polyamide fibers, polyimideamide fibers, polyolefin fibers, polyacrylate fibers, and any combination or blend thereof.

An example of suitable modacrylic fibers are PROTEX™ fibers available from Kaneka Corporation of Osaka, Japan, SEF™ available from Solutia, or blends thereof. Examples of suitable rayon materials are Viscose™ and Modal™ by Lenzing, available from Lenzing Fibers Corporation. An example of an FR rayon material is Lenzing FR™, also available from Lenzing Fibers Corporation, and VISIL™, available from Sateri. Examples of lyocell material include TENCEL™, TENCEL G100™ and TENCEL A100™, all available from Lenzing Fibers Corporation. Examples of para-aramid fibers include KEVLAR™ (available from DuPont), TECHNORA™ (available from Teijin Twaron BV of Arnheim, Netherlands), and TWARON™ (also available from Teijin Twaron BV). Examples of meta-aramid fibers include NOMEX™ (available from DuPont), CONEX™ (available from Teijin), APYEIL™ (available from Unitika), ARAWIN (available from Toray). An example of a polyester fiber is DACRON® (available from Invista™). An example of a PIPD fiber includes M5 (available from Dupont). An example of melamine fibers is BASOFIL™ (available from Basofil Fibers). An example of PAN fibers is Panox® (available from the SGL Group). Examples of UHMW polyethylene materials include Dyneema and Spectra. An example of a liquid crystal polymer or aromatic polyester material is VECTRAN™ (available from Kuraray).

In some embodiments, the AC fibers (such as the AC version of any of the fibers identified above) constitute 15-80%, inclusive, of the fiber blend of the fabric; 15-75%, inclusive, of the fiber blend of the fabric; 15-70%, inclusive, of the fiber blend of the fabric; 20-70%, inclusive, of the fiber blend of the fabric; 30-60%, inclusive, of the fiber blend of the fabric; 40-60%, inclusive, of the fiber blend of the fabric; or 40-50%, inclusive, of the fiber blend of the fabric. In some embodiments, the AC fibers constitute at least 15% and (i) no more than 70%, (ii) no more than 65%, (iii) no more than 60%, (iv) no more than 55%, (v) no more than 50%, or (vi) no more than 40% of the fiber blend of the fabric.

Other, non-AC fibers (such as the non-AC version of any of the fibers identified above) may be, but do not have to be, blended with the AC fibers. In some embodiments, the non-AC fibers constitute 20-85%, inclusive, of the fiber blend of the fabric; 25-85%, inclusive, of the fiber blend of the fabric; 30-85%, inclusive, of the fiber blend of the fabric; 30-80%, inclusive, of the fiber blend of the fabric; 40-70%, inclusive, of the fiber blend of the fabric; 40-60%, inclusive, of the fiber blend of the fabric; 50-60%, inclusive, of the fiber blend of the fabric.

The AC fibers and/or non-AC fibers provided in the fabric need not all be the same. For example, the fiber blend may include the same type of AC fiber or, alternatively, different types of AC fibers may be provided in the blend. Similarly, the blend may include the same type of non-AC fiber or, alternatively, different types of non-AC fibers may be provided in the blend.

In some embodiments, the AC fibers are producer-colored aramid fibers, such as meta-aramid, para-aramid, or blends thereof. However, other AC inherently flame resistant fibers may be used, including, but not limited to, producer-colored FR rayon, producer-colored FR cellulosics, producer-colored FR modacrylic, producer-colored Kermel, producer-colored FR polyacrylate (PyroTex), producer-colored FR nylon, producer-colored PBI, producer-colored PBO, and producer-colored FR polyester.

The AC fibers provided in the blend can be, but need not be, AC inherently FR fibers. Rather, in other embodiments, the fabric is instead formed with AC non-inherently FR fibers, including, but not limited to, modacrylic fibers, ultra-high molecular weight (UHMW) polyethylene fibers, UHMW polypropylene fibers, polyvinyl alcohol fibers, liquid crystal polymer fibers, nylon (and FR nylon) fibers, silk fibers, polyamide fibers, polyester fibers, natural and synthetic cellulosic fibers (e.g., cotton, rayon, acetate, triacetate, and lyocell), wool fibers, pre-oxidized acrylic fibers, polyamide fibers, polyolefin fibers, and polyacrylate fibers. Such AC non-inherently FR fibers may be used as long as the resulting fabric is flame resistant. It may be desirable to include in the blend AC fibers other than inherently FR fibers that tend to be more comfortable yet still enable the fabric to achieve desired arc ratings.

In still other embodiments, the fabric includes a blend of AC inherently FR fibers and AC non-inherently FR fibers. For example, blends that include AC aramid fibers as well as non-aramid AC fibers may be desirable.

In still other embodiments, the fibers of the fabric and/or yarns of the fabric and/or the fabric itself may be treated with a flame retardant compound (e.g., phosphorus) so as to render the fabric flame resistant.

Embodiments of the fabric can be of any weight, but in some embodiments are between 3-10 ounces per square yard (osy), inclusive. In other embodiments, the fabrics are between 5-9 osy, inclusive. In some embodiments, the fabrics disclosed herein have a weight between 4-9.5 osy, inclusive; 4.5-9 osy, inclusive; 5-8.5 osy, inclusive; 5-8 osy, inclusive; 5.5-7.5 osy, inclusive; 5-7 osy, inclusive; 5-6.5 osy, inclusive; 4.5-6 osy, inclusive; and 5-6 osy, inclusive. In some embodiments, the fabric weight is less than or equal to 9 osy, 8.5 osy, 8 osy, 7.5 osy, 7 osy, 6.5 osy, 6 osy, 5.5 osy, and/or 5 osy.

Some embodiments of the fabric have an arc rating (ATPV or $E_{BT}$) greater or equal to 4 cal/cm$^2$ so as to have a PPE Category 1 rating under NFPA 70E. Some embodiments have an arc rating arc rating (ATPV or EBT) greater or equal to 8 cal/cm$^2$ so as to have a PPE Category 2 rating under NFPA 70E.

The arc rating of the following example inventive fabrics was tested, and the results set forth in Table 1.

TABLE 1

| Inventive Fabric | Blend | Fabric Weight | Arc Rating (ATPV or $E_{BT}$) | Arc Rating/ Weight |
|---|---|---|---|---|
| 1 | 16% black producer-colored meta-aramid 37% non-AC cellulosic 47% non-AC modacrylic | 4.9 osy | 5.8 $E_{BT}$ | 1.18 |
| 2 | 25% black producer-colored meta-aramid 35% non-AC cellulosic 40% non-AC modacrylic | 5.2 osy | 6.3 ATPV | 1.21 |
| 3 | 30% black producer-colored meta-aramid 30% non-AC cellulosic 40% non-AC modacrylic | 5.5 osy | 7.3 $E_{BT}$ | 1.33 |
| 4 | 50% black producer-colored meta-aramid 25% non-AC cellulosic 25% non-AC modacrylic | 5.4 osy | 8.5 ATPV | 1.57 |

All non-AC cellulosic fibers in Fabrics 1-4 were TENCEL A100™ fibers, and all non-AC modacrylic fibers in Fabrics 1-4 were PROTEX™ fibers. It can be seen from Table 1 that doubling the producer-colored meta-aramid content (e.g., from 25% in Fabric 2 to 50% in Fabric 4) increased the arc rating/fabric weight ratio by 29.8%. Moreover, it can be seen that fabrics having sufficient AC fibers can achieve PPE Category 2 protection (≥8 cal/cm$^2$ ATPV or EBT arc rating), even at low weights (e.g., 6 osy or less, 7 osy or less).

As noted in Table 1, black producer-colored meta-aramid fibers were used in the blends of Fabrics 1-4. It has been found that darker-colored additives (such as navy and black) are particularly effective at increasing the arc rating/fabric weight. However, embodiments of this invention are by no means limited to such darker-colored additives.

Fabrics made with non-AC meta-aramid fibers did not enjoy similar results. Rather, such fabrics generally had an arc rating/fabric weight ratio of approximately 1.0, as demonstrated by the test results of the prior art fabrics in Table 2:

TABLE 2

| Prior Art Fabric | Blend | Fabric Weight | Arc Rating (ATPV or $E_{BT}$) | Arc Rating/ Weight |
|---|---|---|---|---|
| 5 | 65% non-AC meta-aramid<br>35% non-AC FR rayon fiber | 6.5 osy | 6.1 ATPV | 0.94 |
| 6 | 100% non-AC meta-aramid | 6 osy | 6.5 ATPV | 1.08 |

Fabrics 5 and 6 were piece dyed after fabric formation.

The graph of FIG. 1 plots the arc rating/fabric weight ratio for Fabrics 1-6. It can be seen that the arc rating/fabric weight ratio for Fabrics 1-4 are on a completely different curve than Fabrics 5 and 6. The meta-aramid fibers constitute a significantly less percentage of the fiber blend in Fabrics 1-4 as compared to Fabrics 5 and 6, while achieving better arc protection. Thus, more comfortable fibers (such as cellulosics) can be provided in a greater percentage in Fabrics 1-4 such that the resulting FR fabric is not only more protective but also more comfortable to the wearer. The graph also illustrates that inclusion of more AC fibers (in this case, more producer colored meta-aramid fibers) in the blend drastically improves the arc rating/fabric weight ratio.

Embodiments of the fabrics disclosed herein achieve surprisingly high arc rating/fabric weight ratios. In some embodiments, the arc rating/fabric weight ratio is 1.2-1.7, inclusive; 1.25-1.65, inclusive; 1.3-1.6, inclusive; 1.35-1.6, inclusive; 1.4-1.5, inclusive; 1.2-1.6, inclusive; 1.2-1.5, inclusive; 1.2-1.4, inclusive; 1.4-1.7, inclusive; and 1.4-1.6, inclusive. In some embodiments, the arc rating/fabric weight ratio is at least 1.2; at least 1.25; at least 1.3; at least 1.35; at least 1.4; at least 1.45; at least 1.5; at least 1.55; at least 1.6; at least 1.65; and/or at least 1.7. Even higher arc rating/fabric weight ratios may be achieved by increasing the amount of AC fibers (FR or non-FR) in the blend.

As evidenced in Table 3 below, embodiments of the fabrics disclosed herein also comply with the vertical flammability requirements of both ASTM F1506 (char length of 6 inches or less and a two second or less afterflame) and NFPA 2112 (char length of 4 inches or less and a two second or less afterflame), when measured pursuant to the testing methodology set forth in ASTM D6413, as well as the thermal shrinkage requirement (no more than 10% thermal shrinkage) of NFPA 2112.

In some embodiments, it may be desirable (but not required) to incorporate cellulosic or cellulosic and modacrylic fibers in the fiber blend, as these fibers impart excellent moisture management properties to the fabric when tested pursuant to AATCC 79 (Absorbency of Textiles, 2014 edition, incorporated herein by reference). In other words, the fabrics are able to quickly draw moisture away from the wearer's body via capillary action. Under AATCC 79, a droplet of water is deposited on the fabric surface, and the time it takes for the droplet to absorb fully into the fabric is measured. Embodiments of the fabric contemplated herein achieve an absorbency time of 5 seconds or less when tested pursuant to AATCC 79, as evidenced in Table 3 below. Such testing is to be performed on unfinished fabrics as the wicking property of a fabric can be easily manipulated with the use of finishes.

In addition to wicking ability, the air permeability of the fabric is also relevant to the comfort of the fabric. The air permeability of a fabric is determined by test method ASTM D737 (Standard Test Method for Air Permeability of Textile Fabrics, 2016 edition, incorporated herein by reference) and gauges how easily air passes through a fabric. The fabric is placed on a device that blows air through the fabric, and the device measures the volume flow of air through the fabric at a particular pressure (reported as "$f^3$/min/$ft^2$" or cubic foot per minute per square foot). Higher air permeability values mean that the fabric is more breathable, which is typically desirable. Embodiments of the fabric contemplated herein have good air permeability (in the range of 70-90 $f^3$/min/$ft^2$, inclusive) when tested pursuant to ASTM D737, as evidenced in Table 3 below.

TABLE 3

| Property | Test Method | Inventive Fabric 4 (see Table 1) | ASTM 1506 Requirements | NFPA 2112 Requirements |
|---|---|---|---|---|
| Weight (osy) | ASTM D3776 | 5.4 | | |
| Width (pin-pin in) | ASTM D3774 | 60.975 | | |
| Construction | ASTM D3775 | 75 ends × 52 picks | | |
| Vertical Flammability - Before Wash | ASTM D6413 | | | |
| After Flame (seconds) | | 0 | <2 × 2 | <2 × 2 |
| Char Length (inches) | | 1.6 × 1.6 | <6 × 6 | <4 × 4 |
| After Glow (seconds) | | 10.2 × 10.4 | | |
| Vertical Flammability - After 25x AATCC 135 - (3)(IV)(A)iii launderings | ASTM D6413 | | | |
| After Flame (sec) | | 0 | <2 × 2 | <2 × 2 |
| Char Length (inch) | | 1.3 × 1.3 | <6 × 6 | <4 × 4 |
| After Glow (sec) | | 10.6 × 11.2 | | |
| Vertical Flammability - After 100x NFPA 2112 launderings | ASTM D6413 | | | |
| After Flame (sec) | | 0 | <2 × 2 | <2 × 2 |
| Char Length (inch) | | 2.5 × 1.9 | <6 × 6 | <4 × 4 |
| After Glow (sec) | | 13.2 × 12 | | |
| Tensile Strength (lb force) | ASTM D5034 | 109 × 89 | 30 × 30 | |
| Elmendorf Tear (lb force) | ASTM D1424 | 11.9 × 9.6 | 2.5 × 2.5 | |
| Laundry Shrinkage(%) - After 5x AATCC 135 - (3)(IV)(A)iii launderings | AATCC 135 | 1.9 × 0.2 | <3 × 3 | |
| Thermal Shrinkage (%) | NFPA 2112 | | | |
| Before Wash | | 0.7 × 0.4 | | <10 × 10 |
| After 3x NFPA 2112 launderings | | 0.4 × 0 | | <10 × 10 |
| Air permeability (ft3/min/ft2) | ASTM D737 | 64 | | |

TABLE 3-continued

| Property | Test Method | Inventive Fabric 4 (see Table 1) | ASTM 1506 Requirements | NFPA 2112 Requirements |
|---|---|---|---|---|
| Color Fastness: Laundering - 2A (rating) | AATCC 61 | | | |
| Shade Change | | 5 | >3 | |
| Staining Overall | | 4 | | |
| Color Fastness: Laundering - 3A (rating) | AATCC 61 | | | |
| Shade Change | | 5 | | |
| Staining Overall | | 3-4 | | |
| Color Fastness: Crocking (rating) | AATCC 8 | | | |
| Dry | | 4.5 | | |
| Wet | | 3 | | |
| Color Fastness: Xenon Light (rating) | AATCC 16 | | | |
| 20 hr | | 5 | | |
| 40 hr | | 5 | | |
| 60 hr | | 5 | | |
| HTP- Before Wash (cal/cm2) | ASTM F2700 | | | |
| with Spacer | | 10.6 | | >6 |
| w/o Spacer | | 6.4 | | >3 |
| HTP - AW 3x NFPA 2112 launderings (cal/cm2) | ASTM F2700 | | | |
| with Spacer | | 10.7 | | >6 |
| w/o Spacer | | 7.7 | | >3 |
| Wicking Droplet Test (s) - Before Wash | AATCC 79 | 3.7 | | |
| Wicking Droplet Test (s) - After 25x AATCC 135 - (3)(IV)(A)iii launderings | | 1.8 | | |
| Pilling Resistance (rating) | ASTM D3512 | | | |
| 30 min | | 4 | | |
| 60 min | | 4 | | |
| 90 min | | 4 | | |
| 120 min | | 4 | | |

Fabrics of the invention may be formed with spun yarns, filament yarns, stretch broken yarns, or combinations thereof. The yarns can comprise a single yarn or two or more individual yarns that are combined together in some form, including, but not limited to, twisting, plying, tacking, wrapping, covering, core-spinning (i.e., a filament or spun core at least partially surrounded by spun fibers or yarns), etc.

In some embodiments, the fabrics can be formed entirely from yarns having identical fiber blends (i.e., all of the yarns in the fabric are the same). Where identical yarns are used, the fabrics may be formed by traditional weaving technology and traditional knitting technology (e.g., warp knits with various styles and constructions (such as raschel, tricot, and simplex) and weft knits with various styles and constructions (such as flat bed and circular knits, such as double knits (including swiss pique, rib, interlock, etc.) and single knits (including jersey and pique))).

However, in other embodiments, the yarns forming the fabric may not all be identical. Rather, yarns forming the fabric can be of a different yarn type, can have different amounts of the same fibers and/or can have different fibers or different blends of fibers. In addition, it will be recognized that in some embodiments the yarns need not be blended at all. In other words, some yarns could be 100% of a single fiber type.

Use of different yarns permits the fabric to be constructed to achieve specific goals (e.g., dyeing/printing, cost reduction, etc.) without sacrificing the efficacy of the fabric. For example, it may be desirable to form the fabric from a first type of yarn engineered more for wearer protection (hereinafter referred to as the "protective yarns") and a second type of yarn engineered more for a secondary property, such as comfort and/or dyeability/printability (hereinafter referred to as the "secondary yarns"). By way only of example, the protective yarns may contain more AC fibers whereas the secondary yarns may contain more fibers to achieve the desired secondary property (e.g., comfort, dyeability, printability, etc.).

The protective yarns may be combined with secondary yarns in various ways to form various fabric embodiments. Yarns formed of differing fibers or fiber blends (e.g., protective and secondary yarns) may be woven or knitted in different ways, some of which result in different properties being imparted to different sides of the fabric.

For example and with respect to weaving, one of the warp or fill yarns could be of the protective yarns and the other of the warp or fill yarns could be of the secondary yarns. The fabric could be woven (such as via a twill, satin, or double-cloth weave construction) so that the warp and fill yarns (and thus the protective and secondary yarns) are exposed predominantly on opposing sides of the fabric. In this way, one side of the fabric contributes more protection to the wearer against heat transmission while the other side of the fabric contributes more to the desired secondary property (comfort, dyeability/printability, etc., depending on the make-up of the secondary yarns).

In other embodiments, not all of the warp or fill yarns are the same. For example, protective and secondary yarns may be provided in both the warp and fill directions by providing protective yarns on some ends and picks and secondary yarns on other ends and picks (in any sort of random arrangement or alternating pattern). Or all of the yarns in one of the warp or fill direction could be identical and different yarns used only in the other of the warp or fill direction.

Similarly and with respect to knitting, protective yarns may be knitted with secondary yarns in a variety of ways. The protective and secondary yarns may be knitted using single knit technology (for example, plating, etc.) or double-knit technology such that the protective yarns will be located primarily on one side of the fabric to enhance wearer protection and the secondary yarns will be located primarily on the opposing side of the fabric to enhance comfort or dyeability/printability (or whatever secondary property the secondary yarn is tailored to contribute) to the fabric.

Constructing the fabric such that opposing sides of the fabric have different properties may be desirable for various reasons. For example, if the majority of the more easily dyeable/printable fibers are concentrated on one side of the fabric, that side can be colored more easily to the desired shade or pattern, which otherwise might be difficult if more of the AC fibers were exposed on that side. This is particularly the case where producer-colored aramid fibers (and even more particularly darker colors of such AC fibers) are used. These darker fibers can be concentrated on one side of the fabric, leaving the opposing side available for dyeing and printing more easily (particularly to lighter shades of color). As another example, if the AC fibers only need to be exposed on the fabric face (the face that would be exposed in the garment during use) but not on the fabric back, the secondary yarns can be formed of less expensive fibers to reduce the fabric cost.

Fabrics formed of protective and secondary yarns provided on opposing sides of the fabric may be oriented in a variety of ways within a garment, depending on the use of the garment. If incorporated into garments where it is desirable that the exterior of the garment be dyed or printed, it may useful to expose the side of the fabric with the secondary yarns (which will typically be more conducive to dyeing and/or printing) on the exterior of the garment (facing away from the wearer) and the protective yarns facing the wearer. Alternatively, if dyeing or printing of the fabric is of no consequence, it may be desirable to position the side of the fabric with the secondary yarns (which will typically be more comfortable) in the garment so that the more comfortable yarns are facing the wearer.

In yet other embodiments, the protective and secondary yarns are woven or knitted so that one type of yarn (protective or secondary) is embedded within the fabric so as not to be predominantly exposed on either fabric face. By way only of example, the fabric may be woven or knitted such that one of the protective and secondary yarns is embedded within the fabric so as not to be exposed on a fabric face and the other of the protective and secondary yarns is exposed on both faces of the fabric. In some embodiments, the protective yarn is embedded in the fabric to enhance the thermal protection of the fabric while leaving the secondary yarns exposed on the fabric surface to enhance the comfort and/or dyeability/printability of the fabric. This may be particularly desirable if the protective yarns are darker shades, which would render it difficult to color the fabric to lighter shades if those darker yarns were visible on a fabric face.

In yet another embodiment, some or all of the yarns used in the fabric may be core spun yarns whereby the AC fibers (e.g., producer-colored aramid fibers) form the core (which can be filament, spun, stretch broken, etc.) and fibers having more of the desired secondary property (comfort, dyeability/printability, etc.) can be provided around the core to achieve that secondary property.

The fabrics described herein can be incorporated into any type of garment (uniforms, shirts, jackets, trousers and coveralls) where protection against electric arc flash and/or flames is needed and/or desirable.

In the following, further examples are described to facilitate understanding of aspects of the invention:

EXAMPLE A

A flame resistant fabric comprising a fiber blend comprising at least 15%, and no more than 70%, additive-containing fibers, wherein the fabric has a weight of no more than 9 ounces per square yard and an arc rating of at least 8 cal/cm$^2$.

EXAMPLE B

The fabric of Example A or any of the preceding or subsequent examples, wherein the fiber blend comprises no more than 60% additive-containing fibers.

EXAMPLE C

The fabric of Example A or any of the preceding or subsequent examples, wherein at least some of the additive-containing fibers comprise aramid fibers.

EXAMPLE D

The fabric of Example C or any of the preceding or subsequent examples, wherein at least some of the aramid fibers comprise meta-aramid fibers.

EXAMPLE E

The fabric of Example A or any of the preceding or subsequent examples, wherein at least some of the additive-containing fibers comprise producer-colored fibers.

EXAMPLE F

The fabric of Example E or any of the preceding or subsequent examples, wherein at least some of the producer-colored fibers are aramid fibers.

EXAMPLE G

The fabric of Example F or any of the preceding or subsequent examples, wherein at least some of the producer-colored aramid fibers are navy or black fibers.

EXAMPLE H

The fabric of Example A or any of the preceding or subsequent examples, wherein the fiber blend further comprises a plurality of non-additive-containing fibers.

EXAMPLE I

The fabric of Example H or any of the preceding or subsequent examples, wherein the non-additive-containing fibers comprise at least one of cellulosic fibers and modacrylic fibers.

EXAMPLE J

The fabric of Example I or any of the preceding or subsequent examples, wherein the additive-containing fibers comprise producer-colored aramid fibers and the non-additive-containing fibers comprise cellulosic and modacrylic fibers, wherein the fiber blend comprises 40-60% producer-colored aramid fibers and 40-60% non-additive-containing fibers.

EXAMPLE K

The fabric of Example A or any of the preceding or subsequent examples, wherein the fabric is formed from a plurality of first yarns and a plurality of second yarns, wherein the first yarns are different from the second yarns.

EXAMPLE L

The fabric of Example A or any of the preceding or subsequent examples, wherein the fabric comprises a first side and a second side and wherein the plurality of first yarns are exposed more predominantly on the first side of the fabric and the plurality of second yarns are exposed more predominantly on the second side of the fabric.

EXAMPLE M

The fabric of Example K or any of the preceding or subsequent examples, wherein the first yarns comprise more additive-containing fibers than the second yarns.

EXAMPLE N

The fabric of Example M or any of the preceding or subsequent examples, wherein the second yarns are devoid of additive-containing fibers.

EXAMPLE O

The fabric of Example A or any of the preceding or subsequent examples, wherein the fabric is formed of a plurality of yarns, wherein at least some of the plurality of yarns comprise a core and a sheath, and wherein the core comprises more additive-containing fibers than the sheath.

EXAMPLE P

The fabric of Example A or any of the preceding or subsequent examples, wherein the fabric achieves an absorbency time of five seconds or less when tested pursuant to AATCC 79 (2014).

EXAMPLE Q

The fabric of Example A or any of the preceding or subsequent examples, wherein the fabric achieves an air permeability of 70-90 cubic foot per minute per square foot, inclusive, when tested pursuant to ASTM D737 (2016).

EXAMPLE R

The fabric of Example A or any of the preceding or subsequent examples, wherein the fabric has a weight of no more than 7 ounces per square yard.

EXAMPLE S

The fabric of Example A or any of the preceding or subsequent examples, wherein the fabric has a char length of six inches or less and a two second or less afterflame when measured pursuant to ASTM D6413 (2015).

EXAMPLE T

A flame resistant fabric comprising a fiber blend comprising at least 15%, and no more than 70%, additive-containing fibers, wherein the fabric has a weight and an arc rating, wherein the arc rating per fabric weight is at least 1.2.

Different arrangements of the components described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

We claim:

1. A flame resistant fabric comprising a fiber blend comprising at least 15%, and no more than 70%, additive-containing fibers, wherein the additive-containing fibers contain a dark pigment and wherein the fabric has a weight of no more than 9 ounces per square yard and an arc rating of at least 8 cal/cm$^2$ when tested pursuant to ASTM F1959 (2014).

2. The fabric of claim 1, wherein the fiber blend comprises at least 20% and no more than 60% additive-containing fibers.

3. The fabric of claim 1, wherein at least some of the additive-containing fibers comprise aramid fibers.

4. The fabric of claim 3, wherein at least some of the aramid fibers comprise meta-aramid fibers.

5. The fabric of claim 1, wherein at least some of the additive-containing fibers comprise at least one of cellulosic, modacrylic, polyester, or nylon fibers.

6. The fabric of claim 5, wherein the at least some of the additive-containing fibers comprise at least one of cellulosic or modacrylic fibers.

7. The fabric of claim 1 wherein the dark pigment is navy or black.

8. The fabric of claim 1, wherein the additive-containing fibers comprise first fibers in the fiber blend and wherein the fiber blend further comprises second fibers devoid of a dark pigment.

9. The fabric of claim 8, wherein the second fibers comprise at least one of cellulosic fibers and modacrylic fibers.

10. The fabric of claim 9, wherein the additive-containing fibers comprise aramid fibers and the second fibers comprise cellulosic and modacrylic fibers, wherein the fiber blend comprises 40-60% additive-containing aramid fibers and 40-60% second fibers.

11. The fabric of claim 1, wherein the fabric is formed from a plurality of first yarns having a first yarn fiber blend and a plurality of second yarns having a second yarn fiber blend, wherein the first yarn fiber blend is different from the second yarn fiber blend.

12. The fabric of claim 11, wherein the fabric comprises a first side and a second side and wherein the plurality of first yarns are exposed more predominantly on the first side of the fabric and the plurality of second yarns are exposed more predominantly on the second side of the fabric.

13. The fabric of claim 11, wherein the first yarn fiber blend comprises more additive-containing fibers than the second yarn fiber blend.

14. The fabric of claim 13, wherein the second yarn fiber blend is devoid of additive-containing fibers.

15. The fabric of claim 1, wherein the fabric is formed of a plurality of yarns, wherein at least some of the plurality of yarns comprise a core and a sheath, and wherein the core comprises more additive-containing fibers than the sheath.

16. The fabric of claim 1, wherein the fabric achieves an absorbency time of five seconds or less when tested pursuant to AATCC 79(2014).

17. The fabric of claim 1, wherein the fabric achieves an air permeability of 70-90 cubic foot per minute per square foot, inclusive, when tested pursuant to ASTM D737(2016).

18. The fabric of claim 1, wherein the fabric has a weight of no more than 7 ounces per square yard.

19. The fabric of claim 1, wherein the fabric has a char length of six inches or less and a two second or less afterflame when measured pursuant to ASTM D6413(2015).

20. The fabric of claim 1, wherein the arc rating per fabric weight is at least 1.2.

21. A flame resistant fabric formed of a fiber blend comprising 30%-60% of first fibers and 40% -70% of second fibers, wherein:

i. the first fibers comprise aramid fibers containing a dark pigment;

ii. the second fibers comprise cellulosic fibers and modacrylic fibers, wherein the cellulosic fibers and the modacrylic fibers are devoid of a dark pigment;

iii. the fabric has a weight of no more than 7 ounces per square yard;

iv. the fabric has an arc rating of at least 8 cal/ $cm^2$ when tested pursuant to ASTM F1959(2014); and v. the fabric has a char length of six inches or less and a two second or less afterflame when measured pursuant to ASTM D6413 (2015).

22. A flame resistant fabric formed by a fiber blend comprising 30% -60% of first fibers containing at least one of an energy absorbing additive or a reflecting additive and 40%-70% of second fibers devoid of an energy absorbing additive and a reflecting additive, wherein:

i. the fabric is formed by a first group of yarns and a second group of yarns and comprises a first side and an opposing second side;

ii. the first group of yarns comprises a first fiber blend comprising a percentage of the first fibers;

iii. the second group of yarns comprises a second fiber blend that is different from the first fiber blend and that (i) comprises a lesser percentage of the first fibers than the first fiber blend or (ii) is devoid of any first fibers;

iv. the first group of yarns is predominantly exposed on the first side of the fabric;

v. the second group of yarns is predominantly exposed on the second side of the fabric;

vi. the fabric has a char length of at least 6 inches and an afterflame of 2seconds or less when tested pursuant to ASTM D6413(2015);

vii. the fabric has a fabric weight of no more than 9 ounces per square yard; and viii. the fabric has an arc rating of at least 8 cal/$cm^2$ when tested pursuant to ASTM F1959(2014).

23. The fabric of claim 22, wherein the fabric is a woven fabric having a warp direction and a fill direction, wherein the first group of yarns is provided only in one of the warp direction or the fill direction and the second group of yarns is provided only in the other of the warp direction or the fill direction.

24. The fabric of claim 22, wherein the first fibers comprise modacrylic fibers containing at least one of an energy absorbing additive or a reflecting additive.

* * * * *